United States Patent [19]

Futamura

[11] 4,049,387

[45] Sept. 20, 1977

[54] EXHAUST GAS PURIFIER

[75] Inventor: Kazumasa Futamura, Toyota, Japan

[73] Assignee: Toyota Jidosha Kogyo Kabushiki Kaisha, Toyota, Japan

[21] Appl. No.: 676,191

[22] Filed: Apr. 12, 1976

[30] Foreign Application Priority Data

July 29, 1975 Japan ..... 50-104996[U]

[51] Int. Cl.[2] ..... F01N 3/10; B01J 1/14

[52] U.S. Cl. ..... 23/277 C; 60/282

[58] Field of Search ..... 23/277 C; 60/282, 302

[56] References Cited

U.S. PATENT DOCUMENTS

| | | | |
|---|---|---|---|
| 3,211,534 | 10/1965 | Ridgway | 23/277 C |
| 3,692,497 | 9/1972 | Keith etal. | 23/288 FC |
| 3,724,218 | 4/1973 | Cole | 23/277 C X |
| 3,751,920 | 8/1973 | Rosenlund | 23/277 G X |
| 3,768,260 | 10/1973 | Glenn | 23/277 C X |
| 3,798,903 | 3/1974 | Mitchell et al. | 60/282 |
| 3,799,196 | 3/1974 | Scheitlin et al. | 60/282 X |
| 3,839,862 | 10/1974 | Gota et al. | 23/277 C X |
| 3,899,300 | 8/1975 | D'Olier | 23/277 C |
| 3,904,374 | 9/1975 | Rosenlund | 23/277 C |
| 3,947,545 | 3/1976 | Ishida et al. | 23/277 C X |

*Primary Examiner*—Barry S. Richman
*Attorney, Agent, or Firm*—Brisebois & Kruger

[57] ABSTRACT

Exhaust gas purifier of the manifold reactor type is adapted to prevent the dispersion of heat insulation material contained therein by providing protuberances on the walls enclosing said material which project into said material and thereby inhibit its movement parallel to said walls.

3 Claims, 3 Drawing Figures

EXHAUST GAS PURIFIER

BACKGROUND OF THE INVENTION

Manifold reactors have reburning chambers for reburning the residual carbon monoxide and hydrocarbons in the exhaust gas. these constituents, when reburned, attain a high temperature in the range of 900° ~ 1000° C, so that it is necessary to heat-insulate the reburning chamber to prevent heat transfer to the engine casing as well as to enhance the gas purifying efficiency through efficient reburning.

In conventional methods of heat-insulating a manifold reactor the space between support casing and the outer shell supporting the inner shell is usually filled with a heat-insulating material. The heat-insulating material is so poor in its recuperative powers that, after exposure to repeated cycles of expansion and contraction due to temperature variations in the outer shell of the reburning chamber, the reburning chamber develops a gap between its outer shell and the heat-insulating material; and the heat-insulating material escapes through this gap due to the vibration produced during operation of the vehicle.

As a result the heat-insulation of the manifold reactor becomes less effective and the heat transfer to the engine casing increses, thereby causing various difficulties and unfavorable effects, such as a drop in the gas purifying efficiency.

SUMMARY OF THE INVENTION

According to the present invention, a manifold reactor which is a type of exhaust gas purifier in which the harmful elements in automotive emissions, i.e., carbon monoxide and hydro-carbons, are reburned, is improved by providing an integral projection or projections on the outside of the outer shell supporting the inner shell of the reactor and/or on the inside of the support casing of the reburning chamber.

DETAILED DESCRIPTION OF THE INVENTION

Figure 1:
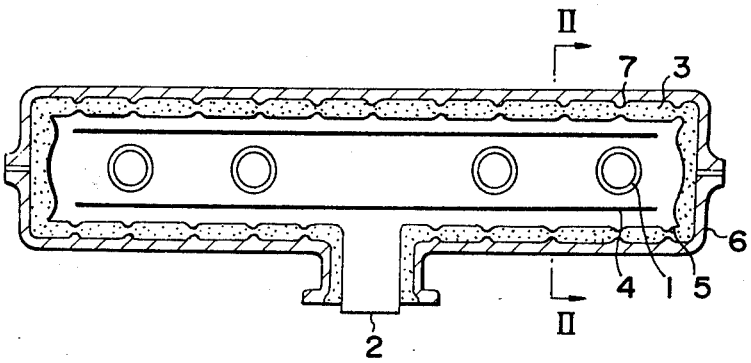
FIG. 1 is a vertical sectional view taken through an exhaust gas purifier according to the present invention.
Figure 2:
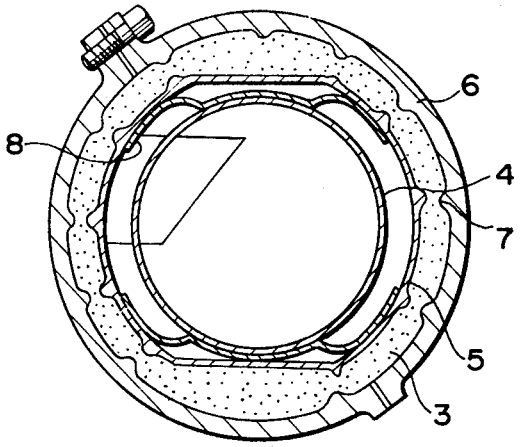
FIG. 2 is a sectional view along the line II—II of FIG. 1.

A specific embodiment of the exhuast gas purifier according to the present invention will now be described with reference to these drawings.

In the manifold reactor shown, the exhaust gas enters through the inlet pipe 1 and, after being reburned, passes out through the outlet pipe 2. The heat-insulating material 3 fills the gap between the support casing 6 and the outer shell 5 supporting the inner shell 4, i.e., the reburning chamber, by means of an inner core support 8.

According to the present invention, at least one projection 7 is integrally formed on the outside of said outer shell 5 and/or on the inside of the support casing 6.

Figure 3:
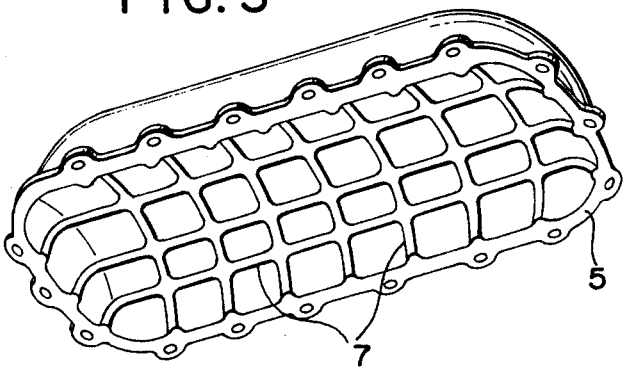
FIG. 3 is a partial oblique view of the outer shell illustrating one embodiment of the projection.

One embodiment of such a projection is illustrated in FIG. 3.

In the exhaust gas purifier according to the present invention, the projections 7 integrally provided on the outside of the outer shell and/or on the inside of the support casing hold the heat-insulating material tightly in position, thereby preventing said material from becoming displaced or from escaping into the exhaust gas during vibrations due to operation of the car.

Thus, in the exhaust gas purifier according to the present invention, the manifold reactor can be kept uniformly hot with the result that the gas purifying efficiency is high and the heat transfer to the engine room is inhibited, thereby eliminating the likelihood of various difficulties.

According to the present invention, said projections may be provided either on the inside of the support casing or on the outside of the outer shell or on both. They may be provided in several parallel rows in only the longitudinal direction of the outer shell, for instance, on the surface of said outer shell, or they may be provided in several rings in the transverse direction. Furthermore, they may be provided in a network as illustrated in FIG. 3. When projections are provided on both the outer shell and the support casing, a better effect will be gained if they are arranged opposite each other. There is no particular restriction to the height of said projections, but projections on one member should not be so high as to reach projections on the other member.

Ceramic fiber is an appropriate heat-insulating material for use in this invention. Better results are obtained if very long ceramic fibers are matted together and employed as the heat-insulating material.

What is claimed is:

1. An exhaust gas purifier comprising:

an outer shell surrounding an inner shell defining a reburning chamber, a support casing surrounding and spaced from said outer shell, a heat insulating material in the space between said outer shell and support casing, a network of elongated outwardly directed projections formed on the outer surface of the outer shell, a network of elongated inwardly directed projections on the inner surface of the support casing, the projections of both of said networks being positioned diametrically opposite each other, the projections on each of said support casing and outer shell forming pockets which partially receive and substantially inhibit displacement of said insulating material during normal use of said purifier.

2. Exhaust gas purifier as claimed in claim 1 in which said network of projections on each of said support casing and outer shell comprise two sets of said projections one set being formed of a plurality of parallel longitudinal rows of projections, with the other set being formed of a plurality of transverse rings of projections.

3. Exhaust gas purifier as claimed in claim 1 in which said insulating material comprises long matted ceramic fibers.

* * * * *